United States Patent [19]

Minejima

[11] Patent Number: 4,579,442

[45] Date of Patent: Apr. 1, 1986

[54] TONER DISPENSING METHOD

[75] Inventor: Teruo Minejima, Tokyo, Japan

[73] Assignee: Konishiroku Photo Industry Co., Ltd., Tokyo, Japan

[21] Appl. No.: 634,187

[22] Filed: Jul. 26, 1984

Related U.S. Application Data

[63] Continuation of Ser. No. 356,763, Mar. 10, 1982, abandoned.

[30] Foreign Application Priority Data

Mar. 27, 1981 [JP] Japan ..... 56-45893

[51] Int. Cl.[4] ..... G03G 15/08; G03G 13/08

[52] U.S. Cl. ..... 355/3 DD; 222/DIG. 1; 355/77

[58] Field of Search ..... 355/3 R, 3 DD, 77, 133; 222/DIG. 1

[56] References Cited

U.S. PATENT DOCUMENTS

| | | | |
|---|---|---|---|
| 3,608,792 | 9/1971 | Hudson | 222/DIG. 1 X |
| 3,873,002 | 3/1975 | Davidson et al. | 222/DIG. 1 X |
| 3,946,910 | 3/1976 | Case | 222/DIG. 1 X |
| 4,054,230 | 10/1977 | Suzuki et al. | 222/DIG. 1 X |
| 4,230,070 | 10/1980 | Murasaki et al. | 222/DIG. 1 X |
| 4,260,073 | 4/1981 | Baumann | 222/DIG. 1 X |

*Primary Examiner*—Fred L. Braun
*Attorney, Agent, or Firm*—James E. Nilles

[57] ABSTRACT

In a method of operating electrostatic reproducing apparatus, developer made of a predetermined ratio of toner and carrier is continuously fed from a reservoir directly to a rotating developing sleeve for transfer to a photosensitive drum to continuously develop electrostatic latent images on the drum. Since some toner in the developer is consumed during image development, fresh toner from a source of supply is continuously dispensed by a movable roller (or endless belt) having toner-carrying recesses on the surface thereof to the reservoir so as to maintain the predetermined ratio of toner and carrier. Used developer containing unconsumed toner is continuously removed from the developing sleeve and a first portion of it is returned directly to the reservoir for re-use, whereas another portion of it is directed past the movable member so as to electrostatically dislodge toner from the roller or belt recesses and facilitate its entry into the reservoir. The roller or belt can be operated at a constant minimum rate of speed based on an estimate of toner consumption or can be operated in response to a measured toner/carrier ratio at a variable rate of speed higher than the minimum.

5 Claims, 3 Drawing Figures

TONER DISPENSING METHOD

This application is a continuation of application Ser. No. 356,763, filed Mar. 10, 1982, now abandoned.

BACKGROUND OF THE INVENTION

1. Field of the Invention

The present invention relates to a toner dispensing method for use with an electrostatic reproducing apparatus.

2. Description of the Prior Art

In an electrostatic reproducing apparatus using a two component developer, the toner is agitated in developing device with a carrier such as iron powder so that it is frictionally charged. When the copying operation is to be performed, the toner is electrostatically trapped by the electrostatic latent image portion of a moving electrophotographically photosensitive member thereby to form a toner image. Since the toner is consumed by the copying operation, it is necessary to perform toner dispensing.

The quantity of toner to be consumed for one copy is about 30 mg at the largest. In the toner dispensing method having been practised in the prior art, therefore, when about several tens or one hundred sheets are copied, the toner is dispensed at one time in a quantity corresponding to the quantity consumed so that its blended ratio with the carrier may be maintained within a predetermined range.

If, however, the toner is dispensed in an excessive quantity at one time, it is insufficiently agitated with the carrier because it has a self-aggregating nature. The toner thus insufficiently agitated and frictionally charged is insufficiently caught by the carrier so as to cause for its scattering during the development and for the deterioration in the picture quality of the copy.

I, the inventor, have made investigations with a view to preventing the toner scattering and have found that the dispensing of the toner in a large quantity at one time will cause the aggregation and scattering of the toner, as has been described in the above.

SUMMARY OF THE INVENTION

The present invention has an object to prevent the scattering of the toner by stabilizing the frictional charge and intends to ensure the agitation of the toner and the carrier by dispensing a toner in a small quantity at all times during the copying operation. According to the present invention, there is provided a toner dispensing method which is characterized in that a toner dispensing device is continuously operated during the operation of an electrostatic reproducing apparatus.

The other objects and advantages of the present invention will be made apparent from the following description taken in conjunction with the accompanying drawings.

DESCRIPTION OF THE PREFERRED EMBODIMENTS

Figure 1:
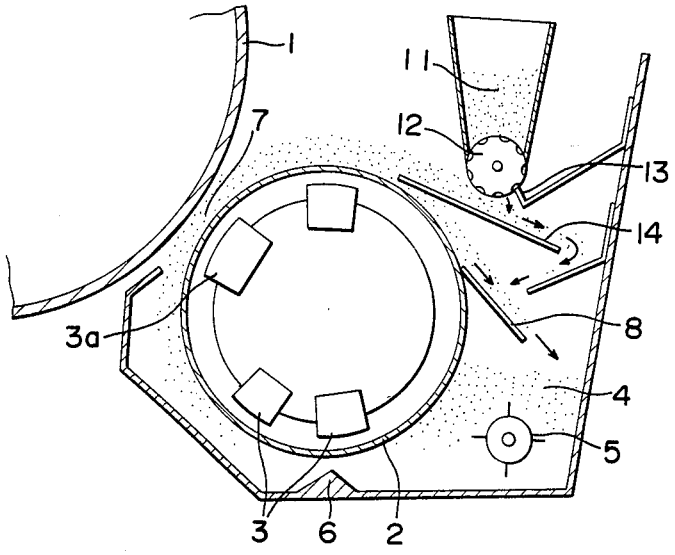
FIG. 1 is a sectional view showing an embodiment of a developing device according to the present invention.

FIG. 1 shows a first embodiment of the present invention and is a section showing a developing device including a hopper.

In FIG. 1, reference numeral 1 indicates a photosensitive drum which is equipped on its circumference with an electrophotographically photosensitive member such as zinc oxide or an organic photoconductor, although only its part is schematically shown.

Numeral 2 indicates a non-magnetic developing sleeve which is arranged in parallel with the photosensitive drum 1. In this developing sleeve 2, there are fixed a group of magnets 3 which have their different poles alternately arranged.

Numeral 4 indicates a developer resevoir, in which the toner is blended and agitated with the carrier and frictionally charged by a rocking agitating blade 5 disposed therein so that the toner is electrostatically caught on the carrier on its circumferential surface.

Numeral 6 indicates a toner regulating plate, by which, when the developing sleeve 2 is clockwise rotated, the developer is regulated into a thin layer corresponding to the gap between the developing sleeve 2 and the toner regulating plate 6 until it is carried out while being caught by the developing sleeve 2.

The developing agent on the developing sleeve 2 is tufted at a developing gap 7 between the photosensitive drum 1 and the developing sleeve 2 by the action of a main magnet 3*a* so that its heads develop the electrostatic latent image on the photosensitive drum 1 thereby to have its toner consumed.

The developer having finished its developing operation is clockwise guided along the developing sleeve 2 and is scraped by a scraper 8 until it is returned to the reservoir 4 for the subsequent agitation.

The present invention relates to the toner dispensing method to be used with the developing device thus far described. The following description is directed to the first embodiment based upon the present invention.

Numeral 11 indicates a hopper which has such a funnel shape as stores the toner therein. In the lower portion of the hopper 11, there is disposed a dispensing roller 12 acting as a rotary member, which is continuously rotated during the copying operation by a motor M.

The dispensing roller 12 is formed in its circumference with thin grooves or small recesses so that, when it is rotated, the toner is carried out of the hopper 11 while occupying the grooves or recesses.

Numeral 13 indicates a scraper for the dispensing roller 12, which is made to have such a shape of a leaf spring as to have its leading end forced into contact with the dispensing roller 12 thereby to scrape away the toner occupying the grooves or recesses.

Numeral 14 indicates a new scraper which has its one end arranged at some spacing from the developing sleeve 2 so that the developer lying in the over layer on the circumference of the developing sleeve may flow onto the scraper 14.

The developer lying in the over layer on the scraper 14 contacts to wash the circumference of the dispensing roller 12 and it flows down along the slope of the scraper 14 into the reservoir 4. The developer thus having flowed down corresponds to the heads of the aforementioned developer and has its toner consumed so that its carrier ratio is so high as to electrostatically eliminate the toner which is caught on the circumference of the dispensing roller 12.

Thus, the toner, which is so preset as to be discharged out of the hopper 11 by the action of the dispensing roller 12, is accurately and reliably dispensed to the reservoir 4 without returning again to the hopper 11 while being caught by the dispensing roller 12.

Figure 2:
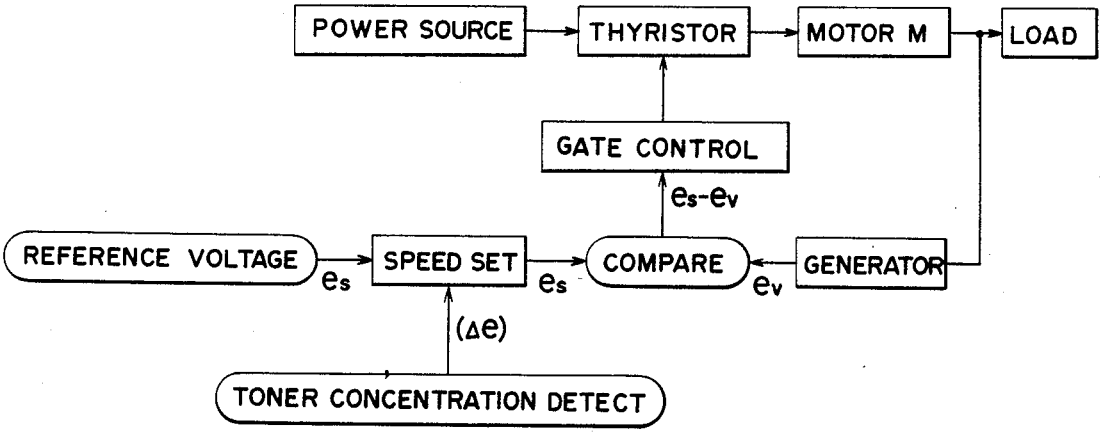
FIG. 2 is a block diagram illustrating the control of the speed of a motor for driving a dispensing roller of FIG. 1.

FIG. 2 is a block diagram illustrating the speed control of the motor M for driving the dispensing roller 12. A reference voltage $e_s$ is preset by the known feedback speed control method using a thyristor, and the operation is so made that the voltage difference of $_3-e_v$ between the reference voltage $e_s$ and the detected voltage $e_v$ by a generator holds at zero, whereby the speed of the motor M is maintained at a preset value $N_0$.

The speed $N_0$ of the dispensing roller 12 thus set is so determined that the quantity of the toner to be dispensed at that speed is 20 mg/copy, for example. This value 20 mg/copy is the averaged minimum toner consumption that is statistically determined. Moreover, another known toner concentration detecting element is provided, and, if the shortage of the toner is detected, an additional voltage $\Delta e$ is added to the reference voltage $e_s$ to increase the speed of the dispensing roller 12 in a manner to satisfy $(e_s+\Delta e)-e_v=0$ so that the quantity of the toner dispensing is augmented to a value such as 40 mg/copy, which is found statistically sufficient. If the copying operation is continued at a state of an ample toner dispensing, the toner concentration is gradually raised until it reaches a normal level. If the toner concentration detecting element detects that the toner concentration is at the normal level, the additional voltage is eliminated so that the speed of the motor M is returned to the preset value $N_0$, whereby the toner dispensing is also returned to the initial value such as 20 mg/copy.

As has been described hereinbefore, according to the present invention, since the toner is dispensed in a small quantity at all times, the toner is not aggregated but is reliably agitated so that it is prevented from any scattering. Because of the toner dispensing in the small quantity, moreover, the toner concentration in the developer is finely adjusted so that it can be administrated to the most proper condition.

In the first embodiment thus far described, incidentally, the dispensing roller 12 has its circumference formed with the unevenness such as the grooves or recesses, by which the toner is carried out of the hopper 11. In an alternative, the circumference of the dispensing roller 12 may be made of a synthetic resin such as polyester having a rough surface or insulated metal having a rough surface so that it may electrostatically catch the toner thereon, whereby the toner can be carried out of the hopper 11. Moreover, it is sufficient that the scraper 14 newly provided is a sloped stationary plate. Nevertheless, if the scraper 14 is so constructed that it is vibrated, the toner caught on the dispensing roller 12 is made to contact with the developer flowing at its vibrated state so that the effect can be more improved.

Figure 3:
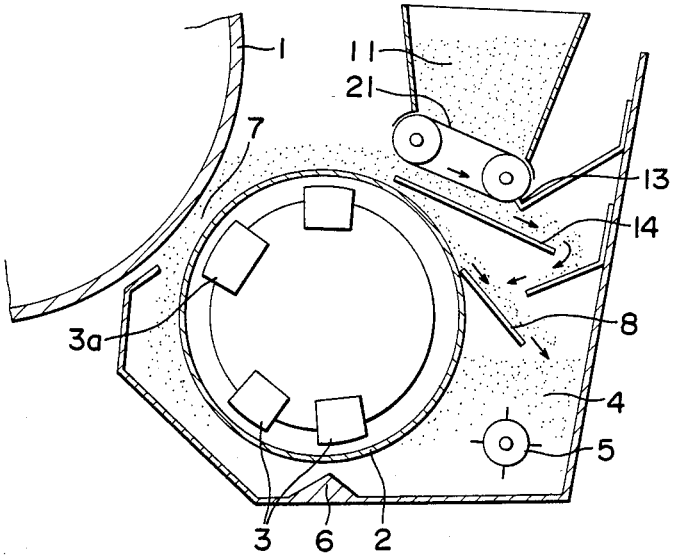
FIG. 3 is a sectional view showing another embodiment of the present invention.

FIG. 3 is a sectional view showing a second embodiment of the present invention, in which the dispensing roller 12 of the first embodiment is replaced by a dispensing belt 21. This dispensing belt 21 is an endless belt made of polyester, which is continuously rotated during the operation of the electrostatic reproducing apparatus so that it can electrostatically catch and carry the toner in the hopper 11 thereby to perform the toner dispensing in a continuous manner, thus enjoying the same effect as that of the first embodiment.

What is claimed is:

1. A method of dispensing toner comprising the steps of:

dispensing toner from a toner hopper into a reservoir containing developer by means of a rotatable supply member;

transferring from said reservoir to the circumferential surface of a developing sleeve developer comprising toner dispensed from said hopper;

removing the over layer of used unconsumed developer from said developing sleeve;

transferring the developer removed from the over layer past said rotatable supply member so as to dislodge toner from said rotatable supply member;

mixing the developer removed from the over layer with the dislodged toner;

removing the under layer of used unconsumed developer from said developing sleeve;

mixing the developer removed from the under layer with the mixture comprising the developer removed from the over layer and the dislodged toner to form a final mixture; and returning the final mixture to said reservoir for re-use.

2. A method according to claim 1 comprising the step of operating said rotatable supply member so as to dispense toner from said toner hopper at a minimum rate based on an estimate of the rate at which toner will be consumed.

3. A method according to claim 2 wherein said minimum rate is a constant rate.

4. A method according to claim 1 comprising the steps of measuring the ratio of toner in the developer being transferred to the surface of said developing sleeve and operating said rotatable supply member in accordance with said ratio so as to dispense toner from said toner hopper at a rate higher than a minimum rate.

5. A method according to claim 4 wherein said higher rate is a variable rate.

* * * * *